US008090283B2

(12) United States Patent
Kuribayashi et al.

(10) Patent No.: US 8,090,283 B2
(45) Date of Patent: Jan. 3, 2012

(54) IMAGE FORMING APPARATUS, CARTRIDGE, AND CLEANING DEVICE

(75) Inventors: Masataka Kuribayashi, Minamiashigara (JP); Toyofumi Inoue, Minamiashigara (JP); Yoshinari Ueno, Minamiashigara (JP); Takafumi Koide, Minamiashigara (JP); Naoki Ohnishi, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 382 days.

(21) Appl. No.: 12/501,651

(22) Filed: Jul. 13, 2009

(65) Prior Publication Data

US 2010/0232823 A1 Sep. 16, 2010

(30) Foreign Application Priority Data

Mar. 11, 2009 (JP) ..... 2009-058444

(51) Int. Cl.
*G03G 21/00* (2006.01)

(52) U.S. Cl. ..... 399/71; 399/358

(58) Field of Classification Search ..... 399/34, 399/71, 350, 358

See application file for complete search history.

(56) References Cited

U.S. PATENT DOCUMENTS

| | | | | |
|---|---|---|---|---|
| 7,177,582 | B2 * | 2/2007 | Ohta et al. | 399/350 |
| 7,266,338 | B2 * | 9/2007 | Baek | 399/350 |
| 7,505,729 | B2 * | 3/2009 | Honda et al. | 399/349 |
| 7,813,690 | B2 * | 10/2010 | Ichikawa et al. | 399/350 |
| 2005/0214045 | A1 * | 9/2005 | Ohta et al. | 399/350 |

FOREIGN PATENT DOCUMENTS

| | | | |
|---|---|---|---|
| JP | 60031174 | A * | 2/1985 |
| JP | 09311601 | A * | 12/1997 |
| JP | A-11-161125 | | 6/1999 |
| JP | A-2001-075445 | | 3/2001 |
| JP | 2005004051 | A * | 1/2005 |
| JP | 2005025162 | A * | 1/2005 |
| JP | 2007139927 | A * | 6/2007 |

* cited by examiner

*Primary Examiner* — Robert Beatty
(74) *Attorney, Agent, or Firm* — Oliff & Berridge, PLC

(57) ABSTRACT

An image forming apparatus includes: an image bearing body on which surface an image is formed and borne; an image forming section that forms the image; a transfer device that transfers the formed image to a transferring body; a cleaning member that comes into contact with the surface of the image bearing body to scrape an adhesion substance after the image is transferred; a storage tank in which the removed adhesion substance is stored; a damming member that obstructs a region between the cleaning member and the storage tank to temporarily dam the adhesion substance moving from the cleaning member to the storage tank on the cleaning member side, the damming member including overlapped members having openings, the members including a movable member that is slidable with respect to other member; and a driving section that drives the movable member to change an overlapping amount between the openings.

14 Claims, 8 Drawing Sheets

IMAGE FORMING APPARATUS, CARTRIDGE, AND CLEANING DEVICE

CROSS-REFERENCE TO RELATED APPLICATIONS

This application is based on and claims priority under 35 USC 119 from Japanese Patent Application No. 2009-058444 filed on Mar. 11, 2009.

BACKGROUND (i) Technical Field

The present invention relates to an image forming apparatus, a cartridge, and a cleaning device.

(ii) Related Art

There is a well-known type of image forming apparatus in which a cleaning member (for example, a rubber blade) removes adhesion substances, such as toner and an external additive, which adhere onto an image bearing body retaining a toner image.

SUMMARY

The present invention has been made in view of the above circumstances and provides an image forming apparatus, a cartridge, and a cleaning device, which can prevent a damming member from excessively damming the adhesion substance.

According to an aspect of the invention, there is provided an image forming apparatus including:

an image bearing body on which surface an image is formed and borne;

an image forming section that forms the image on the surface of the image bearing body;

a transfer device that transfers the image formed on the surface of the image bearing body to a transferring body;

a cleaning member that comes into contact with the surface of the image bearing body to scrape an adhesion substance from the surface after the transfer device transfers the image to the transferring body;

a storage tank in which the adhesion substance removed by and moved from the cleaning member is stored;

a damming member that obstructs a region between the cleaning member and the storage tank to temporarily dam the adhesion substance moving from the cleaning member to the storage tank on the cleaning member side, the damming member including plural overlapped members having openings, the plural members including a movable member that is slidable with respect to other member; and a driving section that drives the movable member to change an overlapping amount between the openings of the plural members.

BRIEF DESCRIPTION OF THE DRAWINGS

Exemplary embodiments of the present invention will be described in detail based on the following figures, wherein.

DETAILED DESCRIPTION

Figure 1:
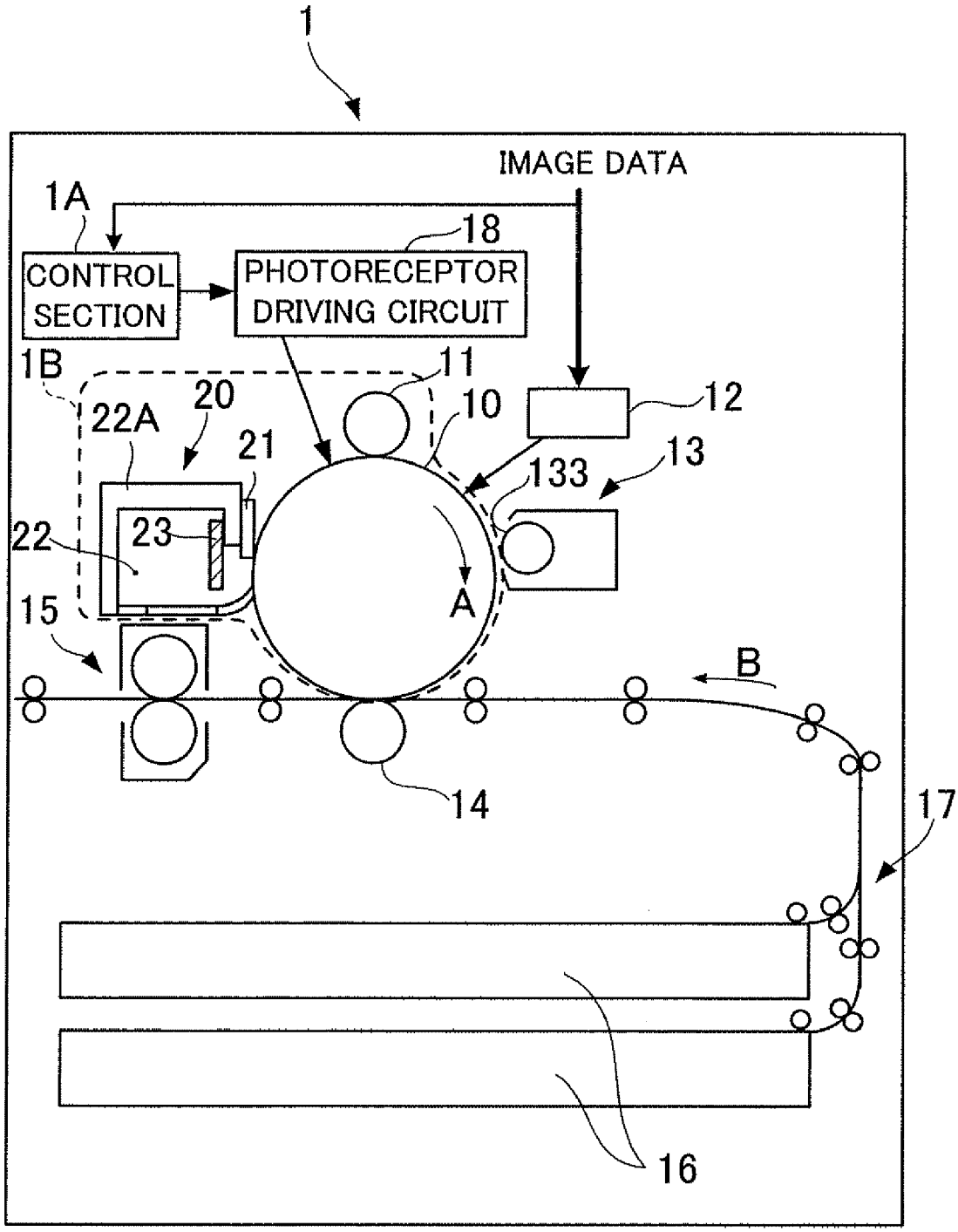
FIG. 1 is a schematic diagram illustrating a structure of a printer.

FIG. 1 is a schematic diagram illustrating a structure of a printer 1.

The printer 1 illustrated in FIG. 1 is a first exemplary embodiment of the image forming apparatus according to the invention. The printer 1 includes a photoreceptor 10, a charging roll 11 that imparts a charge to a surface of the photoreceptor 10, an exposure device 12 that emits exposure light (laser beam) based on image data transmitted from the outside, a development device 13 in which a developer containing toner is stored, a sheet cassette 16 in which a recording sheet is stored, a sheet conveying device 17 that extracts a recording sheet from the sheet cassette 16 to convey the recording sheet, a transfer device 14 that transfers a toner image borne on the surface of the photoreceptor 10 onto the recording sheet conveyed in a direction of an arrow B, a fixing device 15 that fixes the toner image onto the recording sheet by heating and pressurizing the toner image on the recording sheet, and a cleaning device 20 that cleans the surface of the photoreceptor 10. The photoreceptor 10, the charging roll 11, and the cleaning device 20 are provided in a process cartridge 1B, and the process cartridge 1B is detachably attached to the printer 1. The development device 13 includes a development roll 133. The development roll 133 is rotated while facing the photoreceptor 10, and the development roll 133 conveys the developer to a region between the photoreceptor 10 and the development roll 133.

A flow of image forming operation in the printer 1 will briefly be described.

In the printer 1 of FIG. 1, the charging roll 11 imparts a charge to the surface of the photoreceptor 10 rotated in a direction of an arrow A, and the exposure device 12 imparts the surface of the photoreceptor 10 to which the charge is imparted with the exposure light (laser beam) based on an image data transmitted from the outside, thereby forming an electrostatic latent image on the surface of the photoreceptor 10. The developer stored in the development device 13 is supplied to the surface of the development roll 133 and conveyed to a development region between the development roll 133 and the photoreceptor 10, and the electrostatic latent image on the surface of the photoreceptor 10 is developed by the toner in the conveyed developer. The transfer device 14 transfers the toner image obtained by the development onto a recording sheet conveyed in the direction of the arrow B. Then the fixing device 15 heats and pressurizes the toner image on the recording sheet to melt the toner image, thereby fixing the toner image onto the recording sheet.

The photoreceptor 10 is an example of the image bearing body of the invention in which an image is formed and borne on the surface thereof. The charging roll 11, the exposure device 12, and the development device 13 correspond to an example of the image forming section of the invention. The process cartridge 1B is an example of the cartridge of the invention.

The cleaning device 20 includes a cleaning member 21. The cleaning member 21 is located on the downstream side of the transfer device 14 in the rotating direction of the arrow A and on the upstream side of the charging roll 11, and a leading end of the cleaning member 21 is into contact with an overall width of the photoreceptor 10 along the rotating axis of the photoreceptor 10, thereby scraping the toner adhering to a portion of the photoreceptor 10 in which the toner image is already transferred and removing from the surface of the photoreceptor 10. The removed toner is recovered in a storage tank 22 of the cleaning device 20. The cleaning member 21 of the cleaning device 20 is made of a rubber plate-like member, and the cleaning member 21 is fixed to a wall 22A of the cleaning device 20.

In the cleaning device 20, an external additive and the like other than the toner are also removed and recovered as an adhesion substance adhering to the photoreceptor 10 by the cleaning member 21. However, because the toner makes up large part of the adhesion substance, the toner removal and recovery will be described below as a representative of the adhesion substance. Although described in detail later, a damming member 23 is provided in the cleaning device 20 of the first exemplary embodiment in order to enhance the performance of the cleaning member 21 to clean the toner remaining on the surface of the photoreceptor 10. The damming member 23 obstructs a region between the cleaning member 21 and the storage tank 22 to temporarily dam the toner going from cleaning member 21 to the storage tank 22 on the side of the cleaning member 21. The dammed toner forms a toner reservoir between the cleaning member 21 and the damming member 23. When the toner is increased in the toner reservoir, the toner overflows to the storage tank 22 due to flection of the damming member 23. However, because sometimes the excessively increased toner in the toner reservoir affects the motion of the photoreceptor, an opening is provided in the damming member in order to discharge the excessive toner.

In the printer 1, a control section 1A controls the whole of various operations. In FIG. 1, the control section 1A directs a photoreceptor driving circuit 18 to control the rotation of the photoreceptor 10 to indicate that the control section 1A controls the overall operations of the printer 1. The photoreceptor driving circuit 18 drives a motor (not illustrated) to rotate the photoreceptor 10 under the direction of the control section 1A. Image data to be supplied to the exposure device 12 is also supplied to the control section 1A that controls the rotation of the photoreceptor 10. The control section 1A computes density of an image expressed by the image data, and the control section 1A drives a movable member (described later) constituting the damming member according to the image density. Therefore, the control section 1A changes a size of the opening to establish a balance between an amount of toner entering the toner reservoir and an amount of toner discharged from the toner reservoir, and the control section 1A properly controls the toner amount in the toner reservoir.

Although the printer 1 is a monochrome image dedicated machine, the invention may be applied to a color image machine. In the first exemplary embodiment, the photoreceptor is an example of the image bearing body. Alternatively, the image bearing body of the invention may be an intermediate transfer belt.

FIG. 2 illustrates a structure of the cleaning device 20.

Figure 2B:
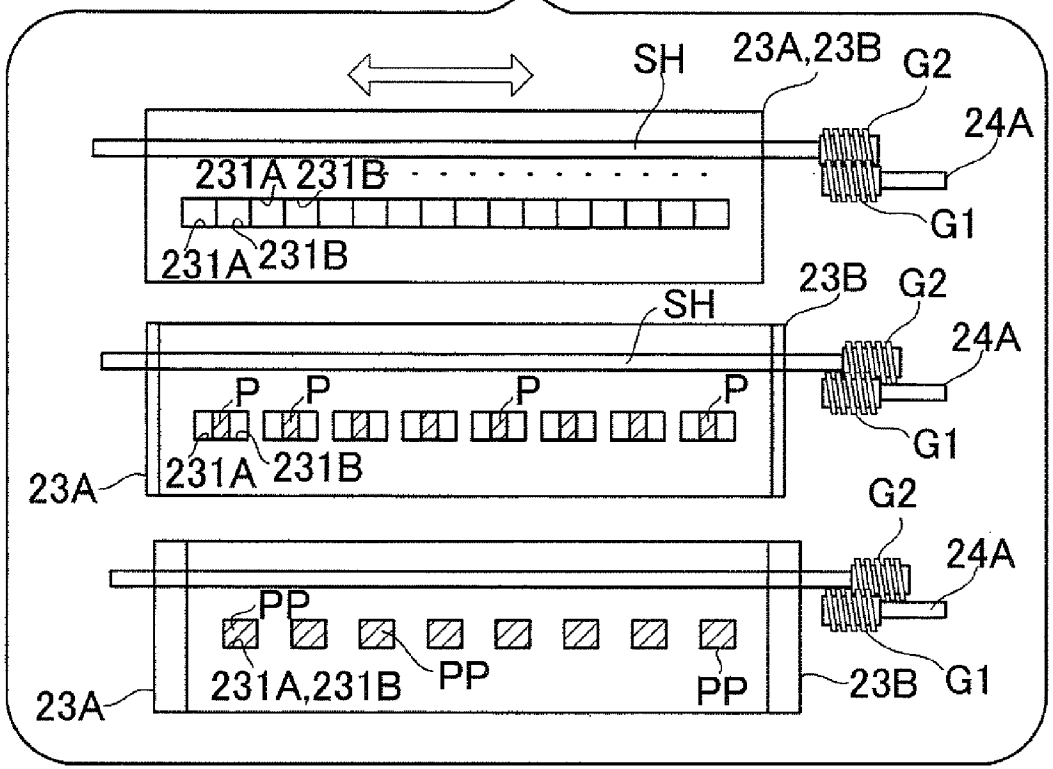
FIG. 2 illustrates a structure of a cleaning device 20.
Figure 2A:
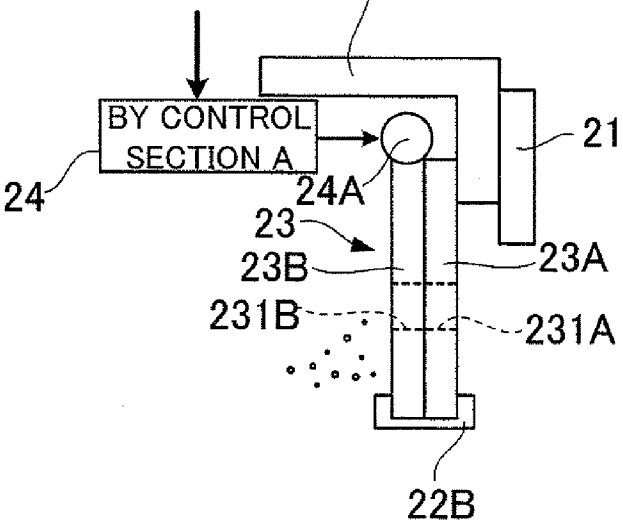

FIG. 2 includes two drawings. FIG. 2A is a side view illustrating the damming member 23 included in the cleaning device 20, and FIG. 2B is a front view of the damming member 23. FIG. 2B illustrates three states of the damming member 23.

As illustrated in FIGS. 2A and 2B, the damming member 23 includes two overlapped members 23A and 23B. Openings 231A and 231B are formed in the members 23A and 233, respectively. The members 23A and 233 are made of PET (polyethylene terephthalate) resin.

The member 23A is fixed to the inside of the wall 22A of the cleaning device 20. The member 23B is fixed to a shaft, and the member 23B is held by a guide 22B while being movable in a horizontal direction of FIG. 2B. The guide 22B extends in parallel with a shaft SH of FIG. 2B, and the guide 22B holds lower ends of the two members 23A and 23B constituting the damming member 23 while the lower ends of the two members 23A and 23B are sandwiched from both horizontal sides of FIG. 2A. The member 23B fixed to the shaft SH is held by the guide 22B while being slidable with respect to the member 23A. For the purpose of distinction between the two members, hereinafter the member that is slidable along the guide is referred to as a movable member 23B and the member fixed to the wall 22A is referred to as a fixed member 23A.

The operation in which the control section 1A drives the movable member 23B to slidably move the movable member 23B with respect to the fixed member 23A will be described below.

FIG. 2A illustrates a driving circuit 24 that drives the movable member 23B under the direction of the control section 1A. The driving circuit 24 rotates a motor whose driving shaft 24A is illustrated in FIGS. 2A and 2B, and a gear G1 is provided in an end portion of the driving shaft 24A (see FIG. 2B).

The shaft SH is fixed to an upper end of the movable member 23B, and the shaft SH is held by a retaining member (not illustrated) so as not to be rotatable but to be slidable in the horizontal direction of FIG. 2B. A gear G2 to be engaged with the gear G1 of the driving shaft 24A is provided in an end portion of the shaft SH. Therefore, when the control section 1A directs the driving circuit 24 to rotate the driving shaft 24A of the motor, an engagement position between the two gears G1 and G2 is changed, and the movable member 23B and the shaft SH are moved in the horizontal direction of FIG. 2B along the guide 22B.

The uppermost part of FIG. 2B illustrates the state in which the movable member 23B and the fixed member 23A are overlapped. In this state, the opening 231B of the movable member 23B and the opening 231A of the fixed member 23A are not overlapped.

Therefore, because the toner is not discharged from the openings 231A and 231B, the toner that is removed and moved by the cleaning member 21 is discharged from below the damming member 23 by the flection of the whole of damming member 23, and the toner is stored in the storage tank 22.

The intermediate part of FIG. 2B illustrates the state in which the movable member 23B and the fixed member 23A are slightly displaced from each other. In this state, the opening 231B of the movable member 23B and the opening 231A of the fixed member 23A are overlapped to about half.

Therefore, the toner is discharged from an overlapping P between the openings 231A and 231B. And the toner that is removed and moved by the cleaning member 21 is discharged from below the damming member 23 by the flection of the damming member 23 as well as from the openings 231A and 231B.

The lowermost part of FIG. 2B illustrates the state in which the movable member 23B and the fixed member 23A are maximally displaced from each other. In this state, the opening 231B of the movable member 23B and the opening 231A of the fixed member 23A are completely overlapped, that is, a maximum overlapping PP between the openings 231A and 231B is realized.

Therefore, the toner is maximally discharged from the openings 231A and 231B, and the amount of toner discharged from the toner reservoir also reaches a maximum.

The control section 1A illustrated in FIG. 1 directs the driving circuit 24 to change the overlapping amount between the openings 231A and 231B in a range of the minimum overlapping amount realized in the state illustrated in the uppermost part of FIG. 2B to the maximum overlapping amount realized in the state illustrated in the lowermost part of FIG. 2B.

When high-density images are continuously formed while the overlapping amount between the openings 231A and 231B remains in the state illustrated in the uppermost part of FIG. 2B, the amount of toner moved from the cleaning member 21 is increased, thereby the toner discharge amount by the flection of the PET damming member 23 becomes insufficient and the toner amount is increased in the toner reservoir. When the toner amount is excessively increased in the toner reservoir, the toner in the toner reservoir is aggregated near the cleaning member 21, and the aggregated toner becomes a large load on the rotation of the photoreceptor 10 to obstruct the rotation of the photoreceptor 10.

Therefore, the control section 1A obtains the same image data supplied to the exposure device 12 and the density of the image expressed by the image data, and based on the image density, indirectly learns the increase or decrease in toner dammed in the toner reservoir by the damming member 23. That is, when the image expressed by the image data has high density, consumption of the toner necessary for the development is increased, the remaining toner (and the external additive and the like) is increased after the image transfer, and the amount of toner removed and recovered by the cleaning device 20 is also increased. Therefore, the toner amount is increased in the toner reservoir. On the other hand, when the image expressed by the image data has low density, the remaining toner (and the external additive and the like) is decreased, and the amount of toner removed and recovered by the cleaning device 20 is also decreased. Therefore, the toner amount is decreased in the toner reservoir.

The control section 1A obtains the image density to learn the increase or decrease in toner, and directs the driving circuit 24 to drive the movable member 23B in order to adjust the overlapping amount between the openings 231A and 231B of the fixed member 23A and movable member 23B, respectively, according to the image density. Therefore, the balance between the amount of toner entering the toner reservoir and the amount of toner discharged from the toner reservoir is adjusted to properly maintain the toner amount in the toner reservoir. As a result, the proper amount of toner is replenished between the cleaning member 21 and the photoreceptor 10, and the toner (and the external additive and the like) on the photoreceptor 10 is appropriately removed by the replenished toner and the cleaning member 21.

The operation in which the control section 1A causes the driving circuit 24 to drive the movable member 23B to properly adjust the toner amount in the toner reservoir based on the image density will be described in detail with reference to FIG. 2B.

In the following description, in an initial state in which the toner reservoir is not formed, it is assumed that the damming member 23 is in the state illustrated in the uppermost part of FIG. 2B.

When the control section 1A is in the initial state (the uppermost part of FIG. 2B), because the toner is not accumulated in the toner reservoir, the control section 1A performs processing for integrating the image density obtained based on the image data in each piece of image data. When the control section 1A learns that the density obtained by the integration processing is lower than density indicating a predetermined integration amount, the control section 1A determines that the toner amount is not properly accumulated in the toner reservoir yet, and maintains the state illustrated in the uppermost part of FIG. 2B without driving the movable member 23B. That is, the control section 1A maintains the state illustrated in the uppermost part of FIG. 2B to increase the amount of toner entering the toner reservoir until the toner amount reaches a proper amount in the toner reservoir. Even in the state illustrated in the uppermost part of FIG. 2B, the toner is hardly discharged from below the damming member 23 until the toner amount reaches a proper amount in the toner reservoir.

When the control section 1A learns that the integration value of the image density becomes an integration value corresponding to a proper amount of toner in the toner reservoir after the images are continuously formed, the control section 1A determines that the toner amount is properly accumulated in the toner reservoir. Then, from the next image formation, the control section 1A directs the driving circuit 24 to drive the movable member 23B to properly control the toner amount in the toner reservoir based on the density obtained by the image data.

When the control section 1A learns that the image density obtained based on the image data is lower than predetermined standard density, the control section 1A maintains the state illustrated in the uppermost part of FIG. 2B. As used herein, the standard density shall mean density at which the amount of toner that is scraped by the cleaning member 21 and enters the toner reservoir is substantially equal to the amount of toner that is moved below the damming member 23 and goes out from the toner reservoir. That is, the toner is properly discharged by the flection of the damming member up to the standard density.

When the control section 1A learns that the image density obtained based on the image data is higher than the predetermined standard density, the control section 1A determines that the toner amount is properly accumulated in the toner reservoir in the state illustrated in the uppermost part of FIG. 2B, and directs the driving circuit 24 to drive the movable member 23B such that the overlapping amount between the openings 231A and 231B of the respective two members 23A and 23B becomes the overlapping amount corresponding to the image density, and the control section 1A puts the damming member 23 into the states illustrated in the intermediate part or lowermost part of FIG. 2B, thereby discharging the excessive toner in the toner reservoir from the overlapping P or PP between the openings.

Thus, when the control section 1A learns that the density of the formed image exceeds the standard density to tend to increase the toner amount in the toner reservoir, the overlapping amount between the openings 231A and 231B of the fixed member 23A and movable member 23B, respectively, is increased to enlarge an area of the toner moving path from the cleaning member 21 to the storage tank 22, and the amount of toner moved from the toner reservoir to the storage tank 22 is increased to properly maintain the toner amount in the toner reservoir. On the other hand, when the control section 1A learns that the image density is lowered to tend to decrease the toner amount in the toner reservoir, the overlapping amount between the openings 231A and 231B is decreased to properly maintain the toner amount in the toner reservoir. The control section 1A continuously adjusts the overlapping amount between the openings 231A and 231B in a non-step manner according to the image density.

When the control section 1A directs the driving circuit 24 to drive the movable member 23B according to the image density increase and decrease corresponding to the increase and decrease of the toner amount in the toner reservoir, the toner amount in the toner reservoir is properly maintained, and the proper amount of toner is replenished between the photoreceptor 10 and the leading end of the rubber plate-like cleaning member 21 that is in contact with the photoreceptor 10. As a result, the toner (and the external additive and the like) on the photoreceptor 10 does not slip through the leading end of the cleaning member 21, but the toner is securely removed to prevent the increase in rotational load on the photoreceptor 10.

In the first exemplary embodiment, the control section 1A is an example of the increase and decrease learning section of the invention, and particularly is an example of the density type increase and decrease learning section. The control section 1A is also an example of the driving control section. The driving circuit 24 and a motor including the driving shaft 24A are an example of the driving section of the invention.

FIG. 3 illustrates a second exemplary embodiment of the invention.

In the second exemplary embodiment, a damming member 33 of a cleaning device 20A and a mechanism retaining the damming member 33 are different from those of the first exemplary embodiment. Also a method of controlling the toner amount in the toner reservoir is different from that of the first exemplary embodiment. In the following description, the components similar to those of the first exemplary embodiment are omitted, and the cleaning device 20A and the toner amount control that are different from those of the first exemplary embodiment will mainly be described.

Figure 3B:
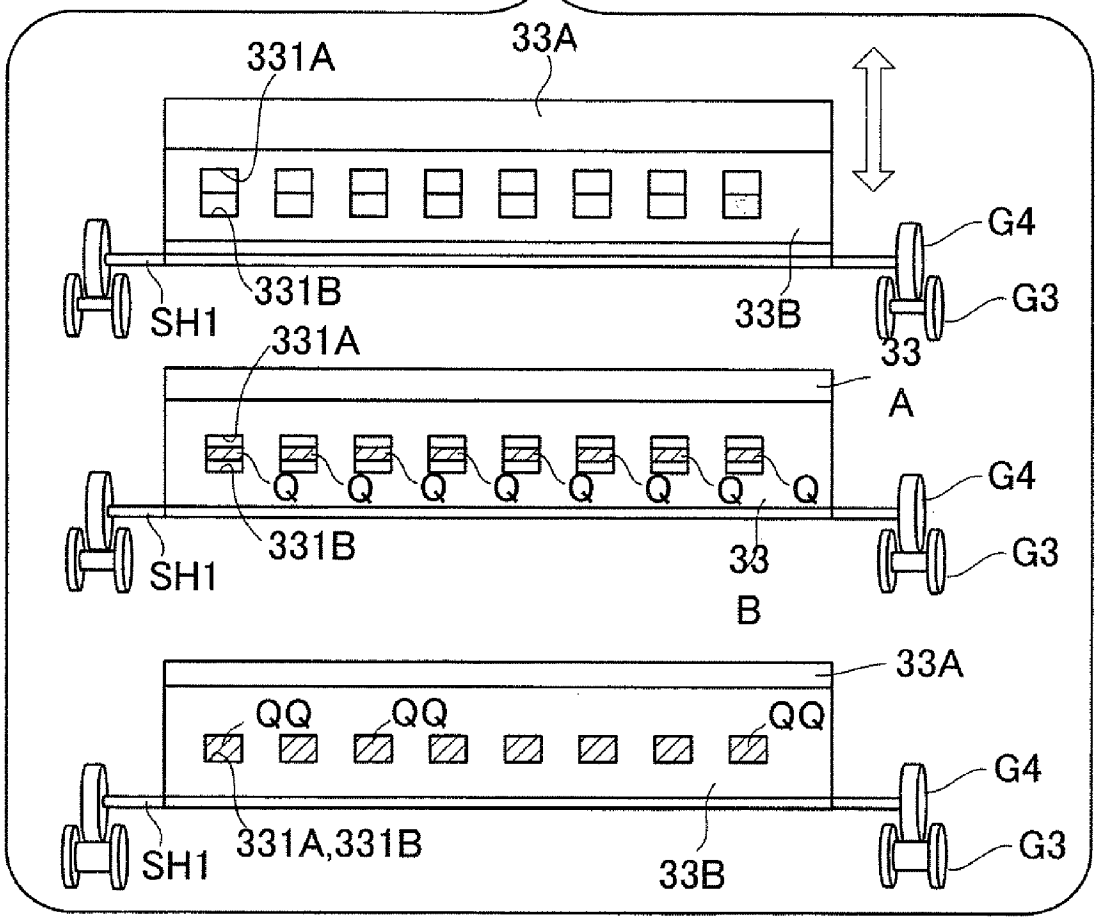
FIG. 3 illustrates a second exemplary embodiment of the invention.
Figure 3A:
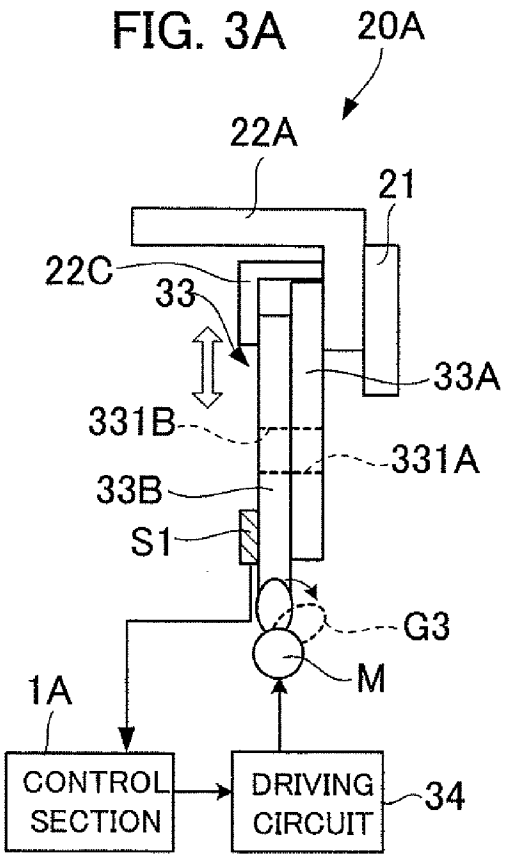

FIG. 3 includes two drawings. FIG. 3A is a side view illustrating the damming member 33 included in the cleaning device 20A of the second exemplary embodiment, and FIG. 3B is a front view of the damming member 33. FIG. 3B illustrates three states of the damming member 33.

As illustrated in FIGS. 3A and 3B, the damming member 33 includes two overlapped members 33A and 33B. Openings 331A and 331B are formed in the members 33A and 33B, respectively. As with the first exemplary embodiment, the members 33A and 33B are made of PET (polyethylene terephthalate) resin.

The member 33A is fixed to the inside of the wall 22A of the cleaning device 20A. The member 33B is fixed to a shaft, and retained by a guide 22C while being movable in a horizontal direction of FIGS. 3A and 3B. The guide 22C extends in parallel with a shaft SH1 of FIG. 3B, and the guide 22C retains upper ends of the two members 33A and 33B constituting the damming member 33 while the upper ends of the two members 33A and 33B are sandwiched from both horizontal sides of FIG. 3A. The member 33B fixed to the shaft SH1 is retained by the guide 22C while being slidable with respect to the member 33A. For the purpose of distinction between the two members, hereinafter the member that is slidable along the guide 22C is referred to as a movable member 33B and the member fixed to the wall 22A is referred to as a fixed member 33A.

In the damming member 33, a distortion sensor S1 is adhered on a side opposite to the cleaning member 21. The distortion sensor S1 is distorted itself by the flection (that is, a kind of distortion) of the damming member 33, and outputs a signal according to magnitude of the distortion.

The operation in which the control section 1A drives and slidably moves the movable member 33B with respect to the fixed member 33A will be described below.

FIG. 3A illustrates a driving circuit 34 that drives the movable member 33B under the direction of the control section 1A. The driving circuit 34 rotates a motor M, and an oval-shaped member G3 is coupled to an end portion of a driving shaft of the motor M.

The shaft SH1 is fixed to a lower end of the movable member 33B, and a contact portion G4 that is in contact with the oval-shaped member G3 is provided in an end portion of the shaft SH1. The shaft SH1 is retained by a retainer (not illustrated) while being movable in a vertical direction of FIG. 3. The shaft SH1 is pressed in a downward direction of FIG. 3 by a spring (not illustrated). When the oval-shaped member G3 is rotated by the motor M to align a minor axis of the oval with the vertical direction of FIG. 3A, the movable member 33B is pulled down by a force of the spring as illustrated in the uppermost part of FIG. 3B. When the minor axis of the oval-shaped member G3 is aligned with the horizontal direction of FIG. 3A, the movable member 33B is pulled up as illustrated in the lowermost part of FIG. 3B. When the minor axis of the oval-shaped member G3 is orientated toward an intermediate direction between the vertical direction and horizontal direction of FIG. 3A, the movable member 33B is in the state illustrated in the intermediate part of FIG. 3B.

That is, when the control section 1A directs the driving circuit 34 to rotate the driving shaft of the motor M to rotate the oval-shaped member G3, the shaft SH1 and the movable member 33B are moved in the vertical direction of FIG. 3B along the guide 22C.

In the state illustrated in the uppermost part of FIG. 3B, the movable member 33B and the fixed member 33A are largely deviated from each other, and the openings are not overlapped.

Therefore, because the toner is not discharged from the openings 331A and 331B in the state illustrated in the uppermost part of FIG. 3B, the toner that is scraped and moved by the cleaning member 21 is discharged from below the damming member 33 by the flection of the whole of damming member 33, and the toner is stored in the storage tank 22.

At this point, for example, when images having a certain level of high density are continuously formed in the state illustrated in the uppermost part of FIG. 3B, the amount of toner moved from the cleaning member 21 is increased, the discharge amount of toner by the flection of the PET damming member 33 becomes insufficient, and the toner amount is increased in the toner reservoir. When the toner amount is excessively increased in the toner reservoir, the toner in the toner reservoir is aggregated near the cleaning member 21, and the aggregated toner becomes a large load on the rotation of the photoreceptor 10 to obstruct the rotation of the photoreceptor 10.

Therefore, the control section 1A directly learns the increase and decrease of the toner dammed by the damming member 33, based on the signal outputted from the distortion sensor S1 adhering to the damming member 33. As described above, the distortion sensor S1 supplies the signal according to the magnitude of the distortion of itself. The distortion of the distortion sensor S1 is generated by the flection of the damming member 33, and the flection of the damming member 33 is generated by a pressure of the toner dammed by the damming member 33. Accordingly, the magnitude of the signal outputted from the distortion sensor S1 indicates the magnitude of the toner pressure, and the increase and decrease of the magnitude of the output signal indicates the increase and decrease of the toner amount. The control section 1A provides instructions to the driving circuit 34 according to the magnitude of the signal outputted from the distortion sensor S1, and the control section 1A causes the driving circuit 34 to drive the movable member 33B to adjust the overlapping amount between the openings of the fixed member 33A and movable member 33B. However, the adjustment of the overlapping amount in the second exemplary embodiment differs from the adjustment of the overlapping amount in the first exemplary embodiment, and it is a stepwise adjustment to be described later.

The operation in which the control section 1A directs the driving circuit 34 to drive the movable member 33B based on the signal outputted from the distortion sensor S1 will be described with reference to FIG. 3B.

In the following description, in the initial state in which the toner reservoir is not formed, it is assumed that the damming member 33 is in the state illustrated in the uppermost part of FIG. 3B.

In the state illustrated in the uppermost part of FIG. 3B, which is the initial state of the control section 1A, the control section 1A does nothing because the magnitude of signal outputted from the distortion sensor S1 is at a lowest level. That is, the control section 1A maintains the state illustrated in the uppermost part of FIG. 3B to increase the toner amount in the toner reservoir until the toner amount reaches a proper amount in the toner reservoir.

After images are continuously formed and the toner amount becomes proper in the toner reservoir, flection begins to be generated in the damming member 33 to increase the magnitude of the signal outputted from the distortion sensor S1. At this point, the control section 1A learns the increase and decrease of the toner in the toner reservoir based on the output signal, and the control section 1A directs the driving circuit 34 to drive the movable member 33B to properly control the toner amount in the toner reservoir.

The control section 1A determines whether the magnitude of the signal outputted from the distortion sensor S1 exceeds a predetermined threshold. When the magnitude of the signal does not exceed the predetermined threshold, the control section 1A maintains the state illustrated in the uppermost part of FIG. 3B without directing the driving circuit 34. The threshold is a value corresponding to a flection amount when the toner is smoothly discharged from below the damming member 33 by the flection of the damming member 33. Even if the flection is generated in the damming member 33, the toner amount is properly maintained in the toner reservoir as long as the toner is smoothly discharged from below the damming member 33. When the magnitude of the signal outputted from the distortion sensor S1 exceeds a first threshold while the damming member 33 is maintained in the state illustrated in the uppermost part of FIG. 3B, the control section 1A determines that the toner is excessively accumulated in the toner reservoir, and directs the driving circuit 34 to drive the movable member 33B such that the overlapping amount between the openings 331A and 331B of the fixed member 33A and movable member 33B, respectively, becomes the state illustrated in the intermediate part of FIG. 3B, and the excessive toner in the toner reservoir is discharged from an overlapping Q between the openings. Therefore, the area of the toner moving path from the cleaning member 21 to the storage tank 22 is increased to increase the amount of toner moved from the toner reservoir to the storage tank 22. As a result, the toner amount in the toner reservoir begins to decrease when normal images are formed with intermediate image density.

The control section 1A causes the driving circuit 34 to drive the movable member 33B to be located at the position illustrated in the intermediate part of FIG. 3B. Then, when the control section 1A learns that the magnitude of the signal outputted from the distortion sensor S1 is smaller than the threshold, that is, when the control section 1A learns that the toner is sufficiently decreased in the toner reservoir, the control section 1A directs the driving circuit 34 to return the openings 231A and 231B of the fixed member 33A and movable member 33B, respectively, to the state in which the openings 231A and 231B are not overlapped as illustrated in the uppermost part of FIG. 3B, so that the toner amount is increased in the toner reservoir.

Thus, when the control section 1A directs the driving circuit 34 to drive the movable member 33B based on the signal outputted from the distortion sensor S1, the toner amount is appropriately increased and decreased to properly maintain the toner amount in the toner reservoir. When the toner amount is properly maintained in the toner reservoir, the toner is properly replenished between the photoreceptor 10 and the leading end of the rubber plate-like cleaning member 21 that is in contact with the photoreceptor 10. Accordingly, the toner (and the external additive and the like) on the photoreceptor 10 is securely removed without slipping through the leading end of the cleaning member 21, and the increase in rotational load on the photoreceptor 10 is avoided.

In the second exemplary embodiment, basically the toner amount is properly maintained in the toner reservoir by the control. However, sometimes the toner amount is not properly maintained by the control when images having higher density are continuously formed. Therefore, in the second exemplary embodiment, the following control is performed in order to deal with such cases.

Even after the control section 1A causes the driving circuit 34 to drive the movable member 33B to be located at the position illustrated in the intermediate part of FIG. 3B, when the control section 1A learns that the magnitude of the signal outputted from the distortion sensor S1 is continuously increased beyond the threshold, that is, when the control section 1A learns that the toner is continuously increased in the toner reservoir, the control section 1A directs the driving circuit 34 to drive the movable member 23B such that the overlapping amount between the openings 231A and 231B of the fixed member 23A and movable member 23B, respectively, becomes the state illustrated in the lowermost part of FIG. 3B, and the toner in the toner reservoir is discharged from a maximum overlapping QQ between the openings. At this point, sizes of the openings 231A and 231B are enough to discharge the toner amount of the toner reservoir in the maximum overlapping QQ even if a solid image is formed. Accordingly, when the overlapping amount between the openings 231A and 231B becomes the state illustrated in the lowermost part of FIG. 38, the toner amount begins to securely be decreased in the toner reservoir, even if an image having a highest density is formed.

The control section 1A causes the driving circuit 34 to drive the movable member 33B to put the openings 231A and 231B in the state illustrated in the lowermost part of FIG. 38. At this point, when the control section 1A learns that the magnitude of the signal outputted from the distortion sensor S1 is lower than the threshold, that is, the toner is sufficiently decreased in the toner reservoir, the control section 1A directs the driving circuit 34 to return the openings 231A and 231B of the fixed member 33A and movable member 33B, respectively, to the state in which the openings 231A and 231B are not overlapped as illustrated in the uppermost part of FIG. 38, thereby increasing the toner amount in the toner reservoir.

Thus, in the second exemplary embodiment, the state illustrated in the intermediate part of FIG. 3B and the state illustrated in the lowermost part of FIG. 3B are separately used based on the change in signal outputted from the distortion sensor S1, so that the toner amount can properly be maintained in the toner reservoir even if an image having a highest density is formed.

In the second exemplary embodiment, the control section 1A corresponds to an example of the increase and decrease learning section of the invention, particularly to an example of the distortion sensing type increase and decrease learning section. The control section 1A also corresponds to an example in which the increase and decrease determination section and the driving control section are combined, and the driving circuit 24, the motor M, and the oval-shaped member G3 correspond to an example of the driving section of the invention.

Figure 4B:
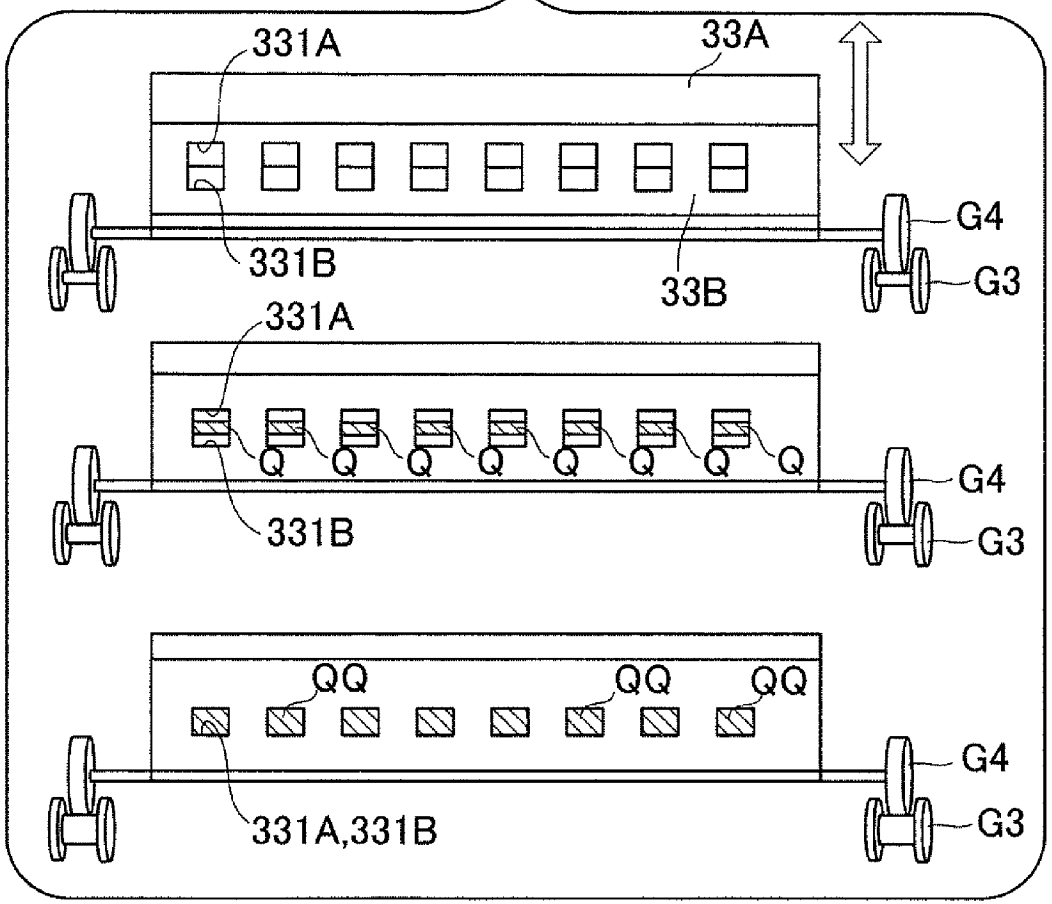
FIG. 4 illustrates a third exemplary embodiment of the invention.

FIG. 4 illustrates a third exemplary embodiment of the invention.

The third exemplary embodiment only differs from the second exemplary embodiment in that a laser displacement meter LM is used instead of the distortion sensor S1 in FIG. 3A.

The laser displacement meter LM irradiates the damming member 33 with a laser beam, receives a reflected light that is reflected from the damming member 33 by a light receiving element, and outputs a signal in accordance with the magnitude of the received light. Although not illustrated, the light receiving element receives the reflected light at a point where the reflected light reaches when the flection is not generated in the damming member 33. The point where the reflected light reaches is displaced accordingly from the position of the light receiving element as the flection of the damming member 33 (that is, a kind of displacement or distortion) is increased. And the amount of a received light received by the light receiving element is decreased as the flection of the damming member 33 is increased, thereby reducing the magnitude of the signal outputted from the laser displacement meter LM. The use of the laser displacement meter LM correctly detects the distortion of the damming member 33 without affecting the motion of the damming member 33 (that is, without interfering with the motion).

In the third exemplary embodiment, the laser displacement meter LM is used instead of the distortion sensor S1 in FIG. 3A, and the control section 1A directly learns the increase and decrease of the toner dammed by the damming member 33 in the toner reservoir based on the detection result of the laser displacement meter LM.

In the third exemplary embodiment, the control section 1A corresponds to an example of the distortion type increase and decrease learning section as well as an example of the increase and decrease determination section of the invention. The laser displacement meter corresponds to an example of the distortion meter of the invention.

Next, a fourth exemplary embodiment of the invention will be described. In the first exemplary embodiment, the control section indirectly learns the increase and decrease of the toner amount in the toner reservoir from the density of the image expressed by the image data. On the other hand, in the fourth exemplary embodiment, the control section indirectly learns the increase and decrease of the toner amount in the toner reservoir from a rotating torque of the rotating photoreceptor 10. Except for the method of learning the increase and decrease of the toner amount, the structure of the fourth exemplary embodiment is similar to that of the first exemplary embodiment.

Figure 5:
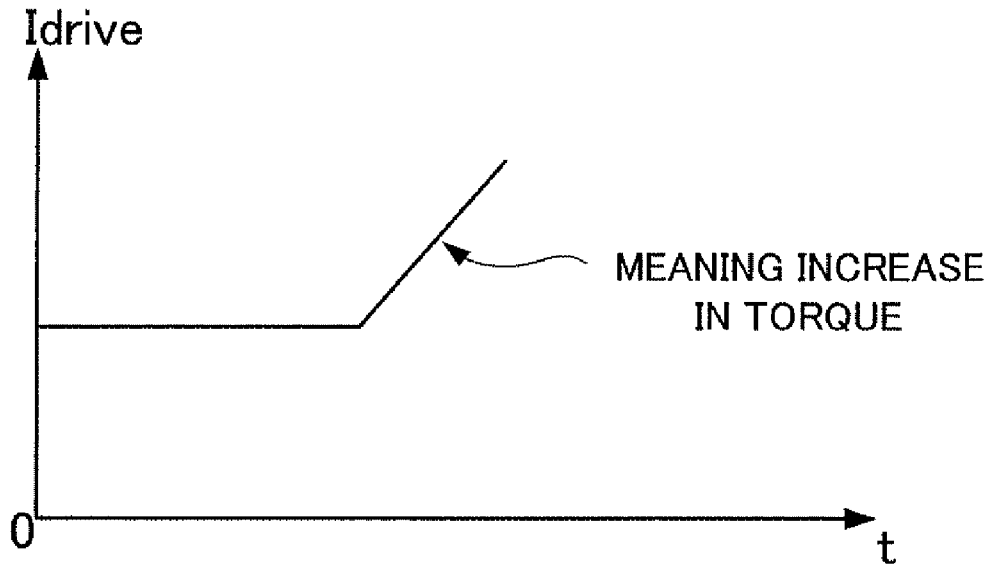
FIG. 5 is a drawing explaining a fourth exemplary embodiment of the invention.

FIG. 5 is a drawing explaining the method of learning the increase and decrease of the toner amount in the fourth exemplary embodiment.

In the fourth exemplary embodiment, the control section 1A of FIG. 1 detects a driving current of the photoreceptor driving circuit 18. FIG. 5 illustrates an example of a change in driving current Idrive detected by the control section 1A over time t.

The photoreceptor driving circuit 18 rotates the photoreceptor 10 at constant speed in order to stably form images. However, when the toner amount is changed in the toner reservoir, in particular when the toner amount is excessively accumulated in the toner reservoir, the rotational load (that is, rotating torque) on the photoreceptor 10 is changed.

That is, when the toner amount is excessively accumulated in the toner reservoir, the toner in the toner reservoir is aggregated near the cleaning member 21 to become the load on the rotation of the photoreceptor 10, and the aggregated toner damps the rotation of the photoreceptor 10. This means that the excessive toner becomes the load to increase the torque for the rotation of the photoreceptor 10.

To keep the rotation speed of the photoreceptor 10 constant even when the rotating torque is increased, the photoreceptor driving circuit 18 automatically adjusts the driving current. Accordingly the increase in the rotating torque induces the increase in the driving current Idrive of the photoreceptor 10 as illustrated in FIG. 5.

The detection of the driving current in the photoreceptor driving circuit 18 corresponds to the detection of the rotating torque of the photoreceptor 10. Because the increase and decrease of the rotating torque are caused by the increase and decrease of the toner amount in the toner reservoir, the control section 1A indirectly learns the increase and decrease of the toner amount in the toner reservoir by detecting the increase and decrease of the driving current. When the control section 1A learns the increase of the toner amount in the toner reservoir from the increase in the driving current Idrive, the control section 1A directs the driving circuit 24 to drive the movable member 23B such that the overlapping amount of the openings of the fixed member 23A and movable member 23B is increased. When the control section 1A learns the decrease of the toner amount in the toner reservoir from the decrease in the driving current Idrive, the control section 1A directs the driving circuit 24 to drive the movable member 23B such that the overlapping amount between the openings of the fixed member 23A and movable member 23B is decreased. In the fourth exemplary embodiment, the overlapping amount is adjusted in the stepwise manner like the second exemplary embodiment.

The toner amount is properly maintained in the toner reservoir when the control section 1A adjusts the overlapping amount between the openings based on the detection result of the driving current Idrive.

In the fourth exemplary embodiment, the control section 1A of FIG. 1 corresponds to an example of the torque type increase and decrease learning section of the invention.

Next, a fifth exemplary embodiment and a sixth exemplary embodiment of the invention will be described. The structures of the fifth and sixth exemplary embodiments are similar to those of the first and second exemplary embodiments except that the sizes of the openings of the members forming the damming member are different from each other.

Figure 6:
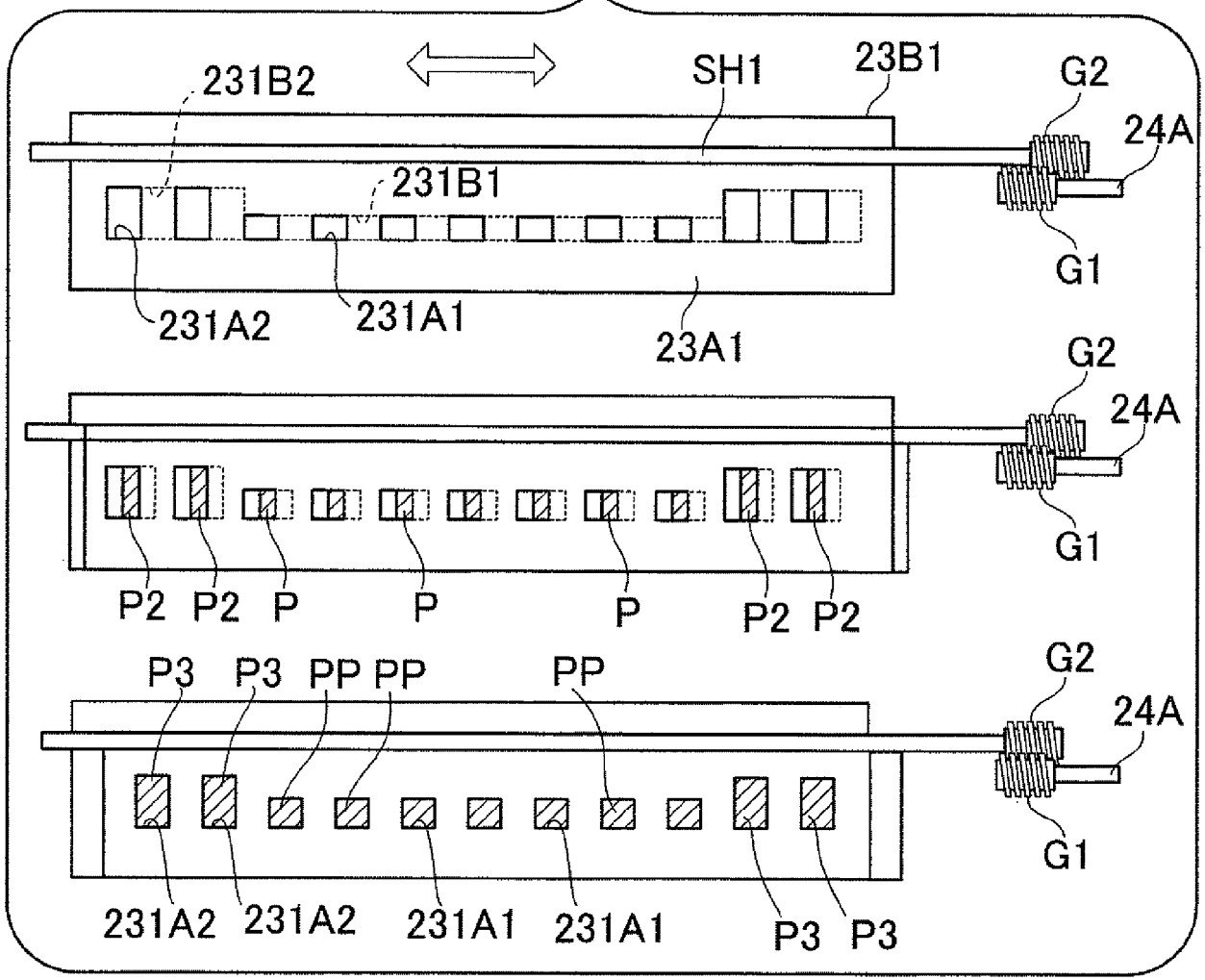
FIG. 6 illustrates a fifth exemplary embodiment.
Figure 7:
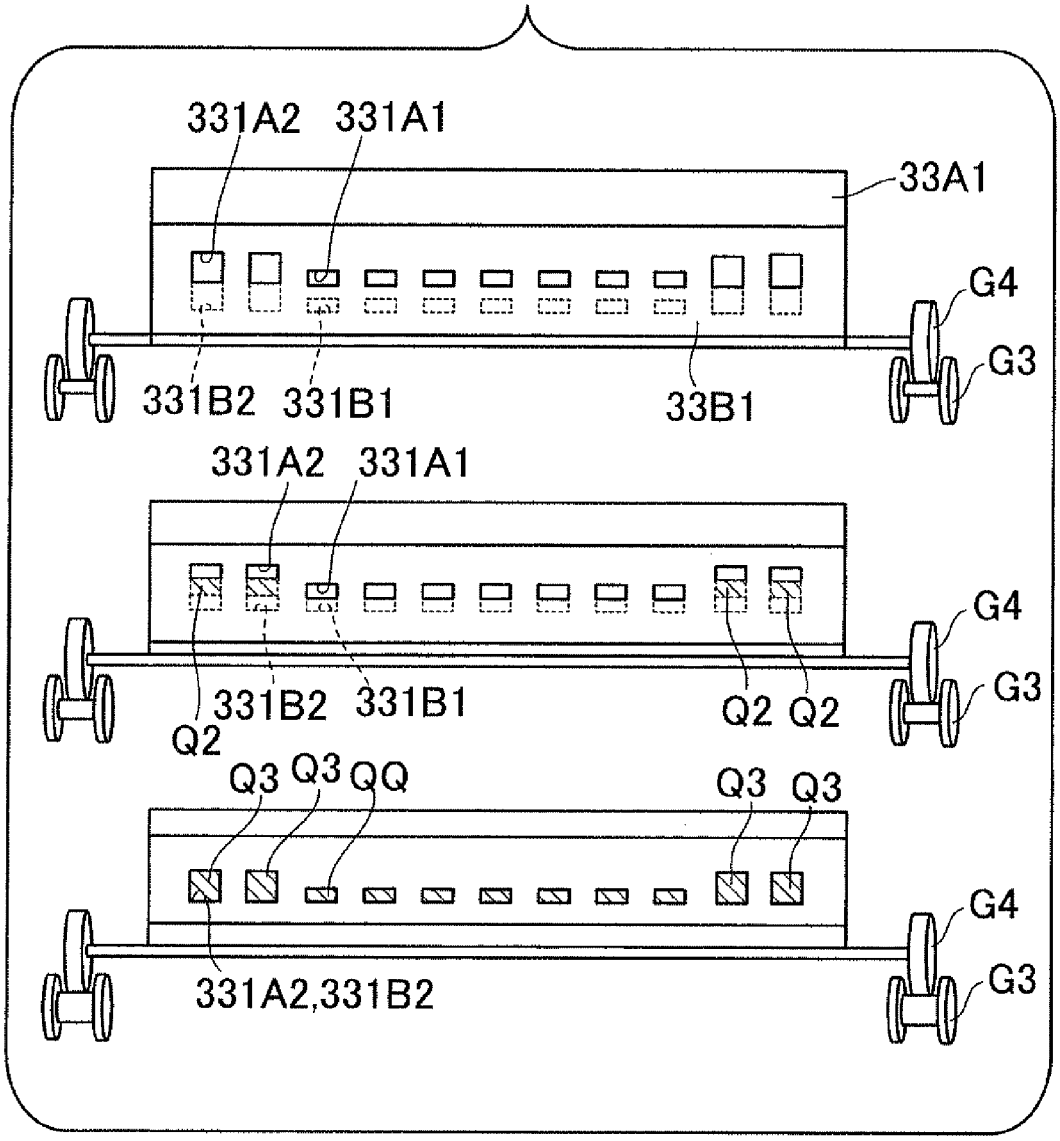
FIG. 7 illustrates a sixth exemplary embodiment.

FIG. 6 illustrates the fifth exemplary embodiment, and FIG. 7 illustrates the sixth exemplary embodiment. The structures of FIGS. 6 and 7 are similar to those of FIGS. 2 and 3 except that, in the openings of the members 23A1 and 23B1 (33A1 and 33B1) constituting the damming member 33, the sizes of openings 231A2 and 23182 (331A2 and 331B2) located at ends in the horizontal directions of FIGS. 6 and 7 are larger than the openings 231A1 and 231B1 (331A1 and 331B1) located in other portions.

In the first to fourth exemplary embodiments, the openings of the members constituting the damming member have the same size. Mechanisms that retain a photoreceptor, a cleaning member, or a damming member are frequently provided at both ends of the image forming apparatus typified by a printer, and the amount of toner dammed in the toner reservoir easily becomes excessive in the end portion of the photoreceptor 10 rather than the central portion.

Therefore, in the fifth and sixth exemplary embodiments, the sizes of the openings 231A2 and 331B2 located at ends of the damming member 33 are made larger than other openings 231A1 and 331B1 as illustrated in FIGS. 6 and 7. Therefore, the overlappings P2, P3, Q2, and Q3 of the openings 231A2 and 331B2 in the end portions of the respective movable members 23B1 and 33B1 are larger than the overlappings P, PP, Q, and QQ of the other openings 231A1 and 33181. As a result, the toner discharged from the overlappings P2, P3, Q2, and Q3 in the end portions are larger than the toner discharged from the overlappings P, PP, Q, and QQ in the central portions. Accordingly, the toner is more efficiently discharged in the end portions in which the toner amount easily becomes excessive in the toner reservoir rather than the central portion, thereby the toner amount is readily maintained at the proper amount in both the central portion and the end portion.

In the exemplary embodiments, a printer is cited as an example of the image forming apparatus of the invention. Alternatively, the image forming apparatus of the invention may be a copying machine or a facsimile. In the exemplary embodiments, the damming member includes two members. Alternatively, the damming member may include three and more members.

Finally, examples corresponding to the respective exemplary embodiments will be described.

Before describing examples 1 to 6 that are of a machine running test performed by employing the printer of FIG. 1 to the first to sixth exemplary embodiments, a test result of the machine running test will be explained as a comparative example 1, to exhibit effects in these examples. The test is performed by a printer employing a damming member 13 having a structure different from those of the damming member 23 and the damming member 33 used in the first to sixth exemplary embodiments.

Figure 8B:
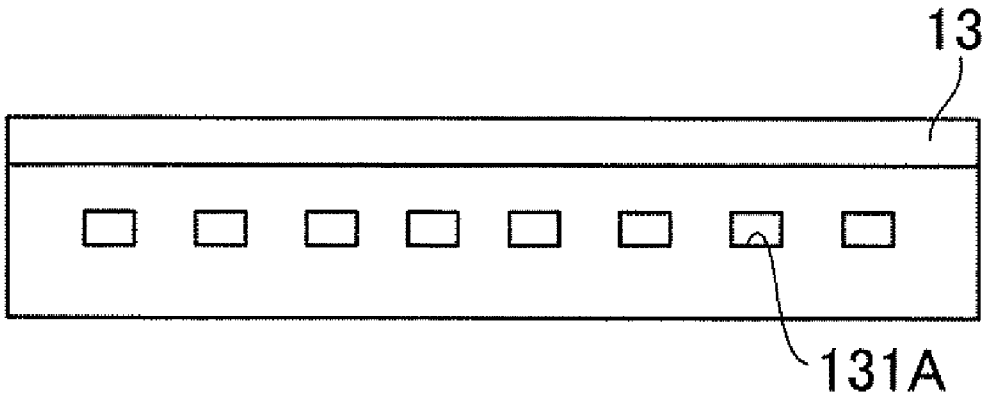
FIG. 8 illustrates a structure of a damming member 13 formed of one member.

FIG. 8 illustrates a structure of a damming member 13 formed of one member. When the damming member 13 of FIG. 8 is used, it is impossible to adjust the size of openings because the movable member is eliminated unlike the damming bodies 23 and 33 of the first to sixth exemplary embodiments.

Comparative Example 1

As a result of the machine running test performed by the printer of FIG. 1 employing the damming member 13 of FIG. 8, the toner amount is excessively increased in the toner reservoir to become the load on the photoreceptor, the motor driven by the photoreceptor driving circuit is stopped due to the overload near 60000 sheets, and the rotation of the photoreceptor is stopped. Consequently, the operation of the printer is stopped.

Example 1

Figure 8A:
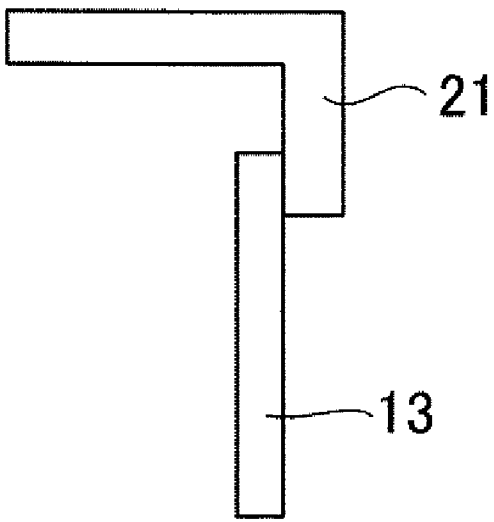

The machine running test is performed by the printer of FIG. 1 in which the damming member 23 of FIG. 2A is mounted instead of the damming member 13 of FIG. 8A. The increase and decrease of the toner are learned from the density of an image, and the movable member 23B of FIG. 2 is driven to adjust the overlapping amount between the openings of the two members forming the damming member in accordance with the image density. As a result, the printer continuously runs up to 100000 sheets without problems.

Example 2

In the printer of FIG. 1, instead of the image density, the control section 1A causes the driving circuit to drive the movable member 23B of FIG. 2 to adjust the overlapping state between the openings of the two members forming the damming member in accordance with the signal outputted from the distortion sensor S1 of FIG. 3A. As a result, the printer continuously runs up to 100000 sheets without problems.

Example 3

Figure 4A:
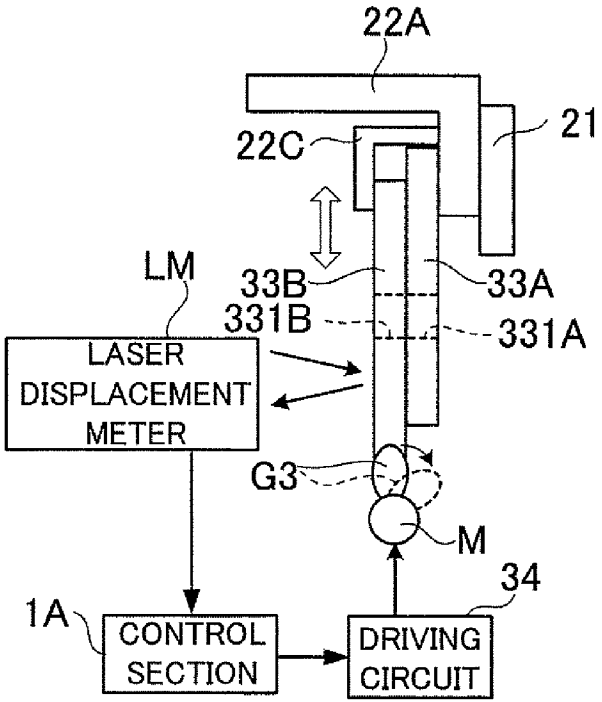

In the printer of FIG. 1, instead of the distortion sensor S1 of FIG. 3A, the laser displacement meter LM of FIG. 4A is used. The control section 1A causes the driving circuit to drive the movable member 33B to adjust the overlapping state between the openings of the two members forming the damming member based on the detection result of the laser displacement meter LM. As a result, the printer continuously runs up to 100000 sheets without problems.

Example 4

In the printer of FIG. 1, the control section 1A causes the driving circuit to drive the movable member 33B to adjust the overlapping state between the openings of the two members forming the damming member in accordance with the increase and decrease of the rotating torque corresponding to the magnitude of the current detected by a current detector in the photoreceptor driving circuit 18. As a result, the printer continuously runs up to 100000 sheets without problems.

Example 5

The machine running test is performed by applying the structure of FIG. 6 to the printer of FIG. 1. As a result, the printer continuously runs up to 100000 sheets without problems.

Example 6

Instead of the structure of FIG. 6, the structure of FIG. 7 is applied to the printer of FIG. 1, and the machine running test is performed. As a result, the printer continuously runs up to 100000 sheets without problems.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling other skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image bearing body on which surface an image is formed and borne;

an image forming section that forms the image on the surface of the image bearing body;

a transfer device that transfers the image formed on the surface of the image bearing body to a transferring body;

a cleaning member that comes into contact with the surface of the image bearing body to scrape an adhesion substance from the surface after the transfer device transfers the image to the transferring body;

a storage tank in which the adhesion substance removed by and moved from the cleaning member is stored;

a damming member that obstructs a region between the cleaning member and the storage tank to temporarily dam the adhesion substance moving from the cleaning member to the storage tank on the cleaning member side, the damming member including a plurality of overlapped members having openings, the plurality of members including a movable member that is slidable with respect to other member; and a driving section that drives the movable member to change an overlapping amount between the openings of the plurality of members.

2. The image forming apparatus according to claim 1, further comprising:

an increase and decrease learning section that directly or indirectly learns the increase and decrease of the adhesion substance dammed by the damming member; and a driving control section that causes the driving section to drive the movable member such that the overlapping amount is increased when the increase and decrease learning section learns the increase of the adhesion substance.

3. The image forming apparatus according to claim 1, further comprising:

a distortion sensing type increase and decrease learning section that detects increase and decrease of distortion of the damming member to learn the increase and decrease of the adhesion substance dammed by the damming member; and a driving control section that causes the driving section to drive the movable member such that the overlapping amount is increased when the distortion sensing type increase and decrease learning section learns the increase of the adhesion substance.

4. The image forming apparatus according to claim 1, further comprising:

a distortion sensor attached to the damming member to output a signal in accordance with the distortion of the damming member;

an increase and decrease determination section that determines the increase and decrease of the adhesion substance dammed by the damming member based on the signal outputted from the distortion sensor; and a driving control section that causes the driving section to drive the movable member to increase the overlapping amount when the increase and decrease determination section determines that the adhesion substance is increased.

5. The image forming apparatus according to claim 1, further comprising:

a distortion meter that irradiates the damming member with light to detect a change in a reflected light from the damming member in accordance with the increase and decrease of the distortion of the damming member;

an increase and decrease determination section that determines the increase and decrease of the adhesion substance dammed by the damming member based on the detection result of the distortion meter; and a driving control section that causes the driving section to drive the movable member to increase the overlapping amount when the increase and decrease determination section determines that the adhesion substance is increased.

6. The image forming apparatus according to claim 1, wherein the damming member includes polyethylene terephthalate.

7. The image forming apparatus according to claim 1, further comprising:

a density type increase and decrease learning section that obtains image data expressing an image formed by the image forming section and obtains increase and decrease of density of the image expressed by the image data to learn the increase and decrease of the adhesion substance dammed by the damming member; and a driving control section that causes the driving section to drive the movable member to increase the overlapping amount when the density type increase and decrease learning section learns the increase of the adhesion substance.

8. The image forming apparatus according to claim 1, further comprising:

a torque type increase and decrease learning section that detects increase and decrease of a rotating torque of the image bearing body to learn the increase and decrease of the adhesion substance dammed by the damming member; and a driving control section that causes the driving section to drive the movable member to increase the overlapping amount when the torque type increase and decrease learning section learns the increase of the adhesion substance.

9. A cartridge comprising:

an image bearing body on which surface an image is formed and borne;

a cleaning member that comes into contact with the surface of the image bearing body to scrape an adhesion substance from the surface;

a storage tank in which the adhesion substance removed by and moved from the cleaning member is stored;

a damming member that obstructs a region between the cleaning member and the storage tank to temporarily dam the adhesion substance moving from the cleaning member to the storage tank on the cleaning member side, the damming member including a plurality of overlapped members having openings, the plurality of members including a movable member that is slidable with respect to other member; and a driving section that drives the movable member to change an overlapping amount between the openings of the plurality of members.

10. The cartridge according to claim 9, further comprising a distortion sensor attached to the damming member to output a signal in accordance with the distortion of the damming member.

11. The cartridge according to claim 9, wherein the damming member includes polyethylene terephthalate.

12. A cleaning device comprising:

a cleaning member that comes into contact with a surface of a cleaned body to scrape an adhesion substance from the surface;

a storage tank in which the adhesion substance removed by and moved from the cleaning member is stored;

a damming member that obstructs a region between the cleaning member and the storage tank to temporarily dam the adhesion substance moving from the cleaning member to the storage tank on the cleaning member side, the damming member including a plurality of overlapped members having openings, the plurality of members including a movable member that is slidable with respect to other member; and a driving section that drives the movable member to change an overlapping amount between the openings of the plurality of members.

13. The cleaning device according to claim 12, further comprising a distortion sensor attached to the damming member to output a signal in accordance with the distortion of the damming member.

14. The cleaning device according to claim 12, wherein the damming member includes polyethylene terephthalate.

* * * * *